US010410584B2

(12) United States Patent
Xie

(10) Patent No.: US 10,410,584 B2
(45) Date of Patent: Sep. 10, 2019

(54) AGING COMPENSATION SYSTEM AND METHOD FOR OLED DEVICE

(71) Applicant: Shenzhen China Star Optoelectronics Semiconductor Display Technology Co., Ltd., Shenzhen, Guangdong (CN)

(72) Inventor: Hongjun Xie, Shenzhen (CN)

(73) Assignee: SHENZHEN CHINA STAR OPTOELECTRONICS SEMICONDUCTOR DISPLAY TECHNOLOGY CO., LTD., Guandong (CN)

( * ) Notice: Subject to any disclaimer, the term of this patent is extended or adjusted under 35 U.S.C. 154(b) by 0 days.

(21) Appl. No.: 15/572,524

(22) PCT Filed: Nov. 2, 2017

(86) PCT No.: PCT/CN2017/109083
§ 371 (c)(1),
(2) Date: Nov. 8, 2017

(87) PCT Pub. No.: WO2018/205513
PCT Pub. Date: Nov. 15, 2018

(65) Prior Publication Data

US 2018/0322829 A1 Nov. 8, 2018

(30) Foreign Application Priority Data

May 8, 2017 (CN) ..... 2017 1 0323856

(51) Int. Cl.

| | |
|---|---|
| ***G09G 3/30*** | (2006.01) |
| ***G09G 3/3258*** | (2016.01) |
| ***G09G 3/3233*** | (2016.01) |
| *G09G 3/10* | (2006.01) |

(52) U.S. Cl.
CPC ..... *G09G 3/3258* (2013.01); *G09G 3/3233* (2013.01); *G09G 2300/0814* (2013.01);
(Continued)

(58) Field of Classification Search
CPC ..... G09G 3/3233; G09G 3/3258
(Continued)

(56) References Cited

U.S. PATENT DOCUMENTS

2006/0158402 A1* 7/2006 Nathan ..... G09G 3/3233 345/82
2007/0195020 A1* 8/2007 Nathan ..... G09G 3/3233 345/76

(Continued)

*Primary Examiner* — Adam J Snyder
(74) *Attorney, Agent, or Firm* — Mark M. Friedman

(57) ABSTRACT

An aging compensation system and an aging compensation method for an organic light emitting diode (OLED) device are disclosed, the aging compensation system for the OLED device comprises a plurality of pixel circuits, a plurality of data lines, a plurality of sense lines, a first power supply, a second power supply, and a source driving chip, the pixel circuit comprises an OLED device and a driving transistor. The number of sense lines and the number of the data lines are equal, each of the sense lines is cooperating with each of the data lines in connection with the pixel circuits, the sense line is connected to an anode of the OLED device via a first transistor; the first power supply is connected to the driving transistor, the second power supply is connected to a cathode of the OLED device; the source driving chip is connected to the data line.

16 Claims, 4 Drawing Sheets

(52) U.S. Cl.
CPC ..... *G09G 2300/0819* (2013.01); *G09G 2300/0842* (2013.01); *G09G 2310/08* (2013.01); *G09G 2320/0233* (2013.01); *G09G 2320/0295* (2013.01); *G09G 2320/043* (2013.01); *G09G 2320/045* (2013.01)

(58) Field of Classification Search
USPC ..... 345/76; 315/169.3
See application file for complete search history.

(56) References Cited

U.S. PATENT DOCUMENTS

2011/0227505 A1* 9/2011 Park ..... H05B 33/0896 315/297
2013/0050292 A1* 2/2013 Mizukoshi ..... G09G 3/3291 345/690
2014/0002332 A1* 1/2014 Huang ..... G09G 3/3233 345/82
2014/0152633 A1* 6/2014 Park ..... G09G 3/3291 345/207
2015/0002502 A1* 1/2015 Kim ..... G09G 3/3233 345/212
2015/0154908 A1* 6/2015 Nam ..... G09G 3/3233 345/76
2016/0012798 A1* 1/2016 Oh ..... G09G 3/325 345/205
2016/0012800 A1* 1/2016 Han ..... G09G 3/3208 345/213
2016/0078813 A1* 3/2016 Mizukoshi ..... G09G 3/3283 345/76
2016/0189621 A1* 6/2016 Kim ..... G09G 3/3258 345/215
2017/0039946 A1* 2/2017 Xie ..... G09G 3/3258

* cited by examiner

AGING COMPENSATION SYSTEM AND METHOD FOR OLED DEVICE

FIELD OF THE INVENTION

The present disclosure relates to the technical field of displays, and particularly to an aging compensation system and an aging compensation method for an organic light emitting diode (OLED) device.

BACKGROUND OF THE INVENTION

Known display types mainly include liquid crystal displays and organic light emitting diode (OLED) displays. Liquid crystal displays have advantages such as having a thin body, reduced power consumption, low radiation, and so on, as well as being widely used. Most of the liquid crystal displays on the market are backlight type liquid crystal displays. Each backlight type liquid crystal display includes a liquid crystal panel and a backlight module. Working principle of the liquid crystal panel is disposing liquid crystal molecules between two parallel glass substrates, applying a driving voltage using the glass substrates to control a rotational direction of the liquid crystal molecules, and then generating a picture by the light transmitted from the backlight module.

Thin film transistor liquid crystal displays (TFT-LCD) have been rapidly developed and widely used in recent years due to their advantages, such as low power consumption, excellent picture quality, and high production yield. Specifically, the TFT-LCD is a layer of liquid crystals sandwiched between the two glass substrates, with a color filter disposed on the upper glass substrate, and thin film transistors disposed on the lower glass substrate. An electric field variation is generated when the current passes through the thin film transistor, a deflection of the liquid crystal molecules is caused by the electric field variation, and thereby polarity of light is changed to achieve a desired display picture.

OLED display technology is different from traditional LCD display technology. For example, OLEDs do not require a backlight source, a very thin organic material coating is applied to the OLED, and the organic material coating is self-illuminating when current passes through it. The OLEDs have advantages such as having a high contrast, a wide color gamut, flexibility, a thin, light body, reduced energy consumption, and so on. In recent years, the OLED display technology has gradually become widely used in the field of mobile devices, such as smart phones and tablet computers, the field of flexible wearable devices such as smart watches, and the field of the large size curved-televisions (TV) and the field of white lighting. Momentum of the development of OLEDs is strong.

For the OLED displays, each pixel includes an OLED device and a pixel driving circuit driving the OLED device to emit light. As usage time of an OLED display increases, the OLED device gradually ages due to aging of the organic materials. After the aging, even if the same amount of current is passed through the same OLED display, there is a reduced display quality of the OLED display, resulting in mura (spots), and gradually decreasing display brightness.

In the prior art, aging compensation for the OLED monitor generally only applies to the display mura caused by the OLED monitor. However, it is unable to improve the problems of gradually decreasing display brightness and residual images.

SUMMARY OF THE INVENTION

An object of the present disclosure is to provide an aging compensation system for an OLED device, which is to improve the problem of the gradual decreasing of the display brightness and residual images by sensing and compensating the OLED device.

Another object of the present disclosure is to provide an aging compensation method for an OLED device, which is to improve the problem of the gradual decreasing of the display brightness and residual images by sensing and compensating of the OLED device.

In order to resolve the above problems, an aging compensation system for an OLED device is provided in a preferred embodiment of the present disclosure, the system comprises: a plurality of pixel circuits, each pixel circuit comprising an OLED device and a driving transistor, the driving transistor being a thin film transistor;

a plurality of data lines;

a plurality of sense lines, wherein number of sense lines is equal to number of the data lines, each of the sense lines being coordinated with each of the data lines in connection with the pixel circuits, wherein each of the sense lines, connected to an anode of the OLED device via a first transistor, senses a voltage $V_{OLED}$ of the OLED device;

a first power supply, connected to the driving transistor;

a second power supply, connected to a cathode of the OLED device between the driving transistor and the second power supply; and a source driving chip, connected to the data line and the sense line, to transmit an image voltage and to generate, based on the voltage $V_{OLED}$ of the OLED device, a compensation voltage for compensating an aging of the OLED device.

The aging compensation system of the preferred embodiment of the present disclosure further comprises a gate driving chip, wherein the pixel circuit comprises a second transistor, a gate of the driving transistor is connected to the data line via the second transistor, a drain of the driving transistor is connected to the first power supply, and the source of the driving transistor is connected to the anode of the OLED device; the sense lines are also used to sense a threshold voltage Vth and a mobility K of the driving transistor; the driving transistor is compensated based on the threshold voltage Vth and the mobility K by the source driving chip.

In the aging compensation system of the preferred embodiment of the present disclosure, a first compensation voltage Vgs' is obtained by a formula:

$$Vgs' = \sqrt{\frac{K0}{K}}\ Vgs + Vth,$$

the first compensation voltage Vgs' is transmitted to the gate of the driving transistor via the data line for compensating the driving transistor, so an amount of electric current required for sensing the aging of the OLED is acquired, such that, the pixels having a same color on a screen have a same luminous current; wherein the $K_0$ is an initial mobility.

The aging compensation system of the preferred embodiment of the present disclosure further comprises a current luminous efficiency η, the current luminous efficiency η is obtained by using the voltage $V_{OLED}$ of the OLED device as an index to map a lookup table, and a value of b is obtained by a formula: $b=\eta/\eta_0$, so that a second compensation voltage Vgs" is obtained by a formula:

$$Vgs'' = \sqrt{\frac{K0}{bK}}\ Vgs + Vth,$$

and is transmitted to the gate of the driving transistor via the data line to compensate the aging of the OLED device and the driving transistor; wherein $\eta_0$ is an initial luminous efficiency.

In the aging compensation system of the preferred embodiment of the present disclosure, the pixel circuit further comprises a capacitor; the gate of the first transistor is connected to a gate driving chip, the source of the first transistor is connected to an anode of the OLED device, and the drain of the first transistor is connected to the sense line; the gate of the second transistor is connected to the gate driving chip, the source of the second transistor is connected to the data line, and the drain of the second transistor is connected to the gate of the driving transistor; the capacitor is connected between the gate of the driving transistor and the source of the driving transistor.

In the aging compensation system of the preferred embodiment of the present disclosure, after a display panel is manufactured, the display panel may be sliced into a plurality of test element groups (TEGs). The TEGs may be illuminated by a passive manner for an execution of an aging testing through a high current. The high current is changed into a low current $I_{typ}$ at a fixed interval during the aging testing. The voltage $V_{OLED}$ and a brightness L are measured and recorded under the low current $I_{typ}$, after the measurement of the voltage $V_{OLED}$ and the brightness L, the low current $I_{typ}$ is increases to the high current to continue the aging testing. The initial luminous efficiency $\eta_0$ is obtained by using an initial brightness $L_0$ and the low current $I_{typ}$ measured initially, which is followed by the low current $I_{typ}$ being used as one of the measuring conditions, to obtain the voltage $V_{OLED}$ and the brightness L, and to calculate the current luminous efficiency $\eta$ for acquiring a relationship between the voltage $V_{OLED}$ and the current luminous efficiency $\eta$. The voltage $V_{OLED}$ is used as an index to find the relationship between the voltage $V_{OLED}$ and the current luminous efficiency $\eta$ in a lookup table. A value of the low current $I_{typ}$ set by a current intensity of one of the TEGs, is equal to a luminous current intensity of the pixel passed throught a current $I_0$, that is, $I_{typ}=I_0*A_{TEG}/A_{pixel}$. The $A_{TEG}$ is a luminous area of a test piece driven by a passive manner, the $A_{pixel}$ is a luminous area of the pixel circuit, the $V_{OLED}$ is the voltage of the test piece driven by the passive manner.

In the aging compensation system of the preferred embodiment of the present disclosure, the first transistor is a thin film transistor.

In the aging compensation system of the preferred embodiment of the present disclosure, the second transistor is a thin film transistor.

In order to resolve the above problems, another aging compensation system for an OLED device is also provided in a preferred embodiment of the present disclosure, which comprises:

a plurality of pixel circuits, each pixel circuit comprising an OLED device and a driving transistor;

a plurality of data lines;

a plurality of sense lines, wherein number of sense lines is equal to number of the data lines, each of the sense lines cooperating with each of the data lines in connection with the pixel circuits, wherein each of the sense lines, connected to an anode of the OLED device via a first transistor, senses a voltage $V_{OLED}$ of the OLED device;

a first power supply, connected to the driving transistor;

a second power supply, connected to a cathode of the OLED device between the driving transistor and the second power supply; and a source driving chip, connected to the data line and the sense line, to transmit an image voltage and to generate, based on the voltage $V_{OLED}$ of the OLED device, a compensation voltage for compensating an aging of the OLED device.

Another aging compensation system of the preferred embodiment of the present disclosure further comprises a gate driving chip, wherein the pixel circuit comprises a second transistor, a gate of the driving transistor is connected to the data line via the second transistor, a drain of the driving transistor is connected to the first power supply, and the source of the driving transistor is connected to the anode of the OLED device. The sense lines are also used to sense a threshold voltage Vth and a mobility K of the driving transistor; the driving transistor is compensated by the source driving chip based on the threshold voltage Vth and the mobility K.

In another aging compensation system of the preferred embodiment of the present disclosure, a first compensation voltage Vgs' is obtained by a formula:

$$Vgs' = \sqrt{\frac{K0}{K}}\ Vgs + Vth,$$

the first compensation voltage Vgs' is transmitted to the gate of the driving transistor via the data line for compensating the driving transistor, so an amount of electric current required for sensing the aging of the OLED is acquired, such that, the pixels having a same color on a screen have a same luminous current; wherein $K_0$ is an initial mobility.

In another aging compensation system of the preferred embodiment of the present disclosure, a current luminous efficiency $\eta$ is obtained by using the voltage $V_{OLED}$ of the OLED device as an index to map a lookup table, and a value of b is obtained by a formula: $b=\eta/\eta_0$, so that a second compensation voltage Vgs" is obtained by a formula:

$$Vgs'' = \sqrt{\frac{K0}{bK}}\ Vgs + Vth,$$

and is transmitted to the gate of the driving transistor via the data line to compensate the aging of the OLED device and the driving transistor; wherein $\eta_0$ is an initial luminous efficiency.

In another aging compensation system of the preferred embodiment of the present disclosure, the pixel circuit further comprises a capacitor; the gate of the first transistor is connected to a gate driving chip, the source of the first transistor is connected to an anode of the OLED device, and the drain of the first transistor is connected to the sense line. The gate of the second transistor is connected to the gate driving chip, the source of the second transistor is connected to the data line, and the drain of the second transistor is connected to the gate of the driving transistor. The capacitor is connected between the gate of the driving transistor and the source of the driving transistor.

In another aging compensation system of the preferred embodiment of the present disclosure, the first transistor is a thin film transistor.

In another aging compensation system of the preferred embodiment of the present disclosure, the second transistor is a thin film transistor.

In order to resolve the above problems, an aging compensation method for an OLED device is provided in a preferred embodiment of the present disclosure, and is applied to an aging compensation system for the OLED device, the aging compensation system comprises:

a plurality of pixel circuits, each pixel circuit comprising an OLED device and a driving transistor;

a plurality of data lines;

a plurality of sense lines, wherein number of sense lines is equal to number of the data lines, each of the sense lines cooperating with each of the data lines in connection with the pixel circuits, wherein each of the sense lines, connected to an anode of the OLED device via a first transistor, senses a voltage $V_{OLED}$ of the OLED device;

a first power supply, connected to the driving transistor;

a second power supply, connected to a cathode of the OLED device between driving transistor and the second power supply;

a source driving chip, connected to the data line and the sense line, to transmit an image voltage and to generate, based on the voltage $V_{OLED}$ of the OLED device, a compensation voltage for compensating an aging of the OLED device;

wherein the aging compensation method comprises steps of:

compensating a value of Vth and a value of K of the driving transistor first, so that the pixels having a same color on a screen have a same luminous current;

acquiring a voltage $V_{OLED}$ when the OLED device is illuminated;

using the acquired voltage $V_{OLED}$ of the OLED device as an index to map a lookup table for obtaining data as a current luminous efficiency η, and acquiring a value of b based on a formula: $b=\eta/\eta_0$;

generating a compensating voltage based on a formula:

$$Vgs'' = \sqrt{\frac{K0}{bK}}\ Vgs + Vth;$$

transmitting the compensating voltage to a gate of the driving transistor via the data line.

In the aging compensation method of the preferred embodiment of the present disclosure, the aging compensation system further comprises a gate driving chip; the pixel circuit comprises a second transistor; the drain of the driving transistor is connected to the data lines via the second transistor, the gate of the driving transistor is connected to a first power supply, and the source of the driving transistor is connected to an anode of the OLED device; the sense lines are also used to sense a threshold voltage Vth and a mobility K of the driving transistor; the driving transistor is compensated based on the threshold voltage Vth and the mobility K by the source driving chip.

In the aging compensation method of the preferred embodiment of the present disclosure, a first compensation voltage Vgs' is obtained by a formula:

$$Vgs' = \sqrt{\frac{K0}{K}}\ Vgs + Vth,$$

the first compensation voltage Vgs' is transmitted to the gate of the driving transistor via the data line for compensating the driving transistor; wherein $K_0$ is an initial mobility.

In the aging compensation method of the preferred embodiment of the present disclosure, the current luminous efficiency η is obtained by using the voltage $V_{OLED}$ of the OLED device as the index to map the lookup table, and the value of b is obtained by the formula: $b=\eta/\eta_0$, so that a second compensation voltage Vgs" is obtained by a formula:

$$Vgs'' = \sqrt{\frac{K0}{bK}}\ Vgs + Vth,$$

and the second compensation voltage is transmitted to the gate of the driving transistor via the data line to compensate the aging of the OLED device and the driving transistor; wherein $\eta_0$ is an initial luminous efficiency.

In the aging compensation method of the preferred embodiment of the present disclosure, the pixel circuit further comprises a capacitor; the gate of the first transistor is connected to a gate driving chip, the source of the first transistor is connected to an anode of the OLED device, and the drain of the first transistor is connected to the sense line; the gate of the second transistor is connected to the gate driving chip, the source of the second transistor is connected to the data line, and the drain of the second transistor is connected to the gate of the driving transistor; the capacitor is connected between the gate of the driving transistor and the source of the driving transistor.

In the aging compensation method of the preferred embodiment of the present disclosure, the driving transistor is a thin film transistor.

In the aging compensation method of the preferred embodiment of the present disclosure, the first transistor is a thin film transistor.

In the aging compensation method of the preferred embodiment of the present disclosure, the second transistor is a thin film transistor.

In the aging compensation method of the preferred embodiment of the present disclosure, after a display panel is manufactured, the display panel may be sliced into a plurality of TEGs. The TEGs may be illuminated by a passive manner for an execution of an aging testing through a high current. The high current is changed into a low current $I_{typ}$ on a constant duration during the aging testing. The voltage $V_{OLED}$ and a brightness L are measured and recorded under the low current $I_{typ}$, after the measurement of the voltage $V_{OLED}$ and the brightness L, the low current $I_{typ}$ is increases to the high current to continue the aging testing. The initial luminous efficiency $\eta_0$ is obtained by using an initial brightness $L_0$ and the low current $I_{typ}$ measured initially, which is followed by the low current $I_{typ}$ being used as one of the measuring conditions, to obtain the voltage $V_{OLED}$ and the brightness L, and to calculate the current luminous efficiency η for acquiring a relationship between the voltage $V_{OLED}$ and the current luminous efficiency η. The voltage $V_{OLED}$ is used as an index to find the relationship between the voltage $V_{OLED}$ and the current luminous efficiency η in a lookup table. A value of the low current $I_{typ}$ set by a current intensity of one of the TEGs, is equal to a luminous current intensity of the pixel passed through a current Jo, that is $I_{typ}=I_0*A_{TEG}/A_{pixel}$ The $A_{TEG}$ is a luminous area of a test piece driven by a passive manner, the $A_{pixel}$ is a luminous area of the pixel circuit, the $V_{OLED}$ is the voltage of the test piece driven by the passive manner.

Compared with the prior art, the present disclosure is achieved by one of the sense lines being coordinated with one of the data lines connected to the pixel circuits, the sense lines and data lines are connected to the source driving chip respectively, to sense the voltage $V_{OLED}$ of the OLED device in the pixel circuit via the sense lines. The source driving chip transfers the voltage $V_{OLED}$ into a digital signal, and transmits the digital signal to a timing control chip (TCON). The timing control chip generates a digital signal of the compensating voltage, based on the voltage $V_{OLED}$ sensed from the sense lines, to transmit the digital signal to the source driving chip. The source driving chip transfers the digital signal into the compensation voltage, and transmits the compensation voltage to the gate of the driving transistor via the data lines for compensating the aging of the OLED device. Under a display mode, the compensation voltage transmitted to the driving transistor via the data lines is coordinated with a zero-volt voltage transmit to the driving transistor via the sense lines, so that the problems of decreasing display brightness caused by the aging of the OLED device and residual images of the display have been improved, to enhance the uniformity of an OLED display screen.

In order that the foregoing description of the present disclosure will become more clear, the preferred embodiments are given hereafter and are to be described in detail with reference to the accompanying drawings.

DETAILED DESCRIPTION OF THE PREFERRED EMBODIMENTS

Figure 1:
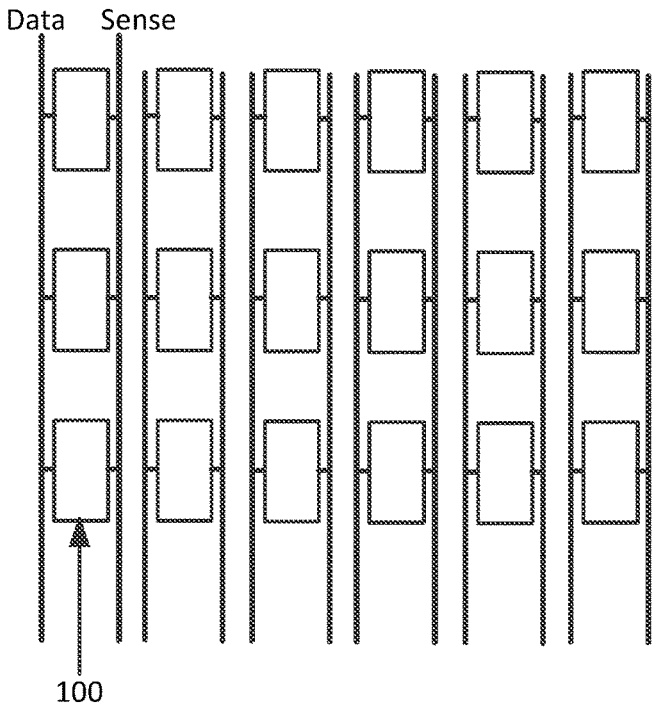
FIG. 1 is a schematic diagram showing a connection between the data lines, the sense lines, and the pixel circuits in an embodiment of the present disclosure.

The following description of the embodiments is given by reference to the accompanying drawings for illustrating specific embodiments in which the disclosure may be embodied.

The specific structural and functional details disclosed herein are merely representative and are intended to describe the purpose of the exemplary embodiments of the present disclosure. The disclosure may be embodied in many substituted forms and should not be construed as limited to the embodiments set forth herein only.

In the description of the present disclosure, it is to be understood that the terms "center", "transverse", "up", "down", "left", "right", "vertical", "horizontal", "top", "bottom", "inside", "outside", and the like, indicated orientations or positional relationships, are based on the orientations or positional relationships shown in the drawings, merely for the purpose of facilitating the description of the disclosure and the simplified description, rather than indicating or implying that the devices or elements have to have a specific orientation, constructed and operated in a particular orientation, and therefore cannot be construed as limits to the present disclosure. In addition, the terms "first" and "second" are merely used for illustrating purposes only, but are not to be construed as indicating or imposing a relative importance or implicitly indicating the number of technical features indicated. Thus, a feature that defines "first" or "second" may expressly or implicitly comprise one or more of the features. In the description of the present disclosure, the meaning of "plural" is two or more, unless otherwise specified. In addition, the term "comprising" and any variations thereof are intended to cover non-exclusive inclusion.

In the description of the present disclosure, it should be noted, unless otherwise expressly stated and defined, the terms "installation", "interconnection", and "connection", should be broadly understood; for example, it may be a fixed connection, either a detachable connection or integral connection; it may be a mechanical connection or an electrical connection; it may be a directed connection or indirected connection via an intermediate medium, either internal connection between two devices. The specific meaning of the above terms of the present disclosure will be apparent to those skilled in the art.

The terminology used herein is for the purpose of describing particular embodiments only and is not intended to limit the exemplary embodiments. Unless the context clearly dictates otherwise, the singular forms "a" and "an", as used herein, are also intended to include the plural. It should also be understood that the terms "comprise" and/or "include" both mean a presence of characteristics, integers, steps, operations, units and/or components stated in the specification, and do not exclude the presence or addition of one or more other features, integers, operations, units, components and/or combinations thereof.

In the figures, the units with similar structures are denoted by the same reference numerals.

An aging compensation system and method for an OLED device of implementing the present disclosure will be described in further detail with reference to FIGS. 1 to 6 and the preferred embodiments.

Embodiments:

As specific embodiments of the present disclosure, as shown in FIGS. 1 to 4, an embodiment of the present disclosure discloses an aging compensation system and method of sensing and compensating for the OLED device.

The aging compensation system comprises a plurality of pixel circuits 100, a plurality of data lines Data, a plurality of sense lines Sense, a first power supply ELVDD, a second power supply ELVSS, a source driving chip IC1, and a gate driving chip IC2.

Figure 2:
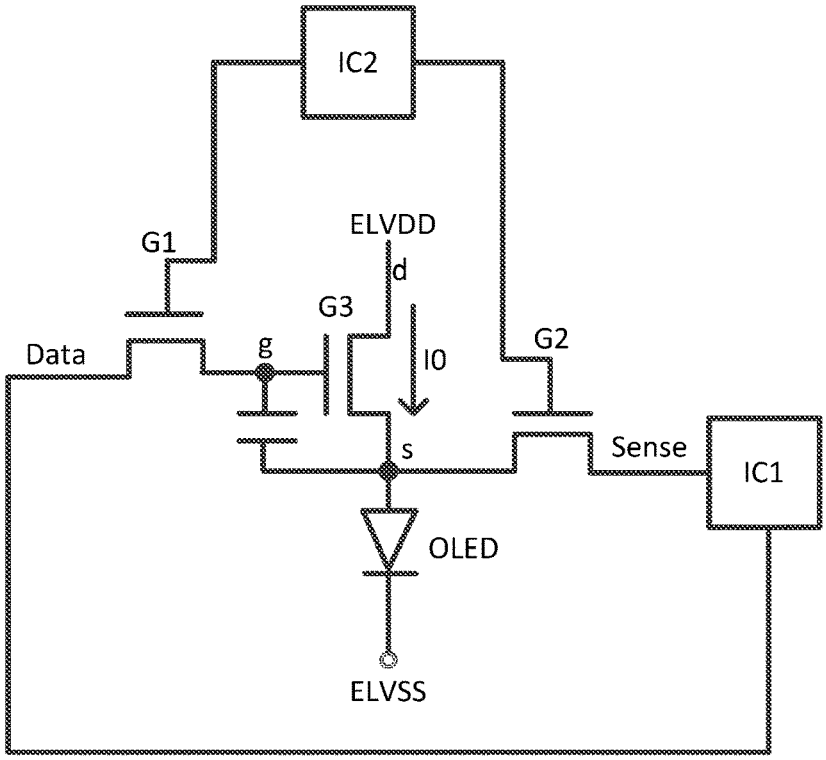
FIG. 2 is a schematic diagram of the pixel circuit and a connection between the pixel circuit and the driving chip in an embodiment of the present disclosure.
Figure 4:
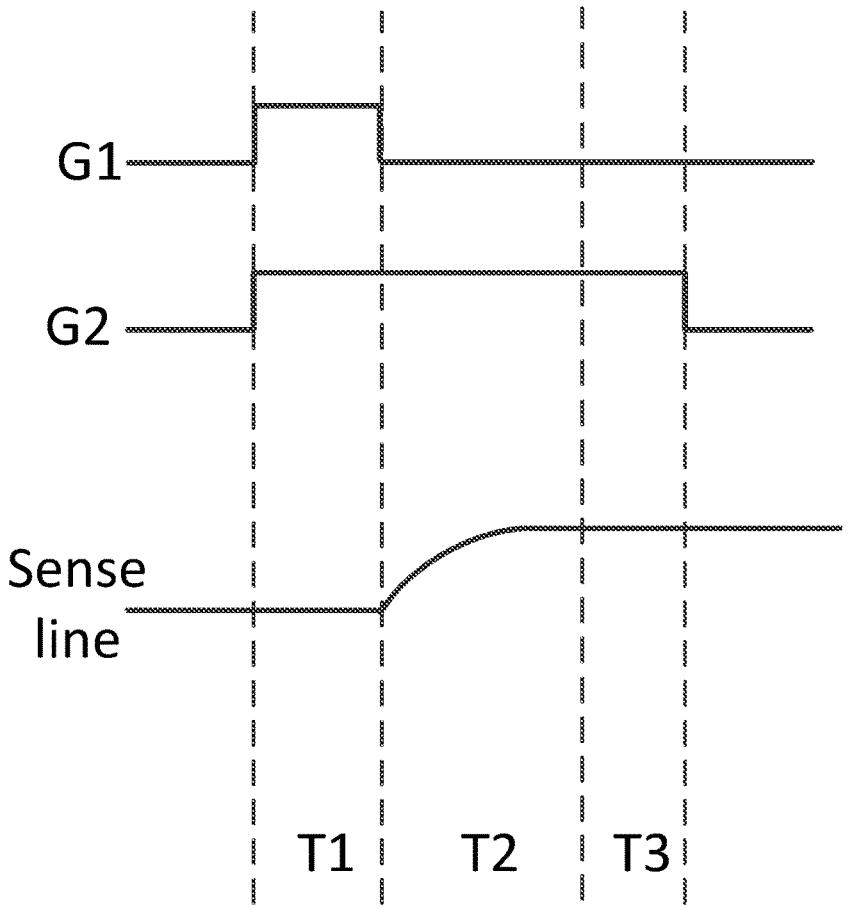
FIG. 4 is a timing diagram of the pixel circuit under the sensing mode in an embodiment of the present disclosure.

It should be noted, as shown in FIGS. 1 and 2, that Data indicates the data lines, and Sense indicates the sense lines, while a Sense line shown in the FIG. 4 indicates a signal sensed by the sense lines.

There are a plurality of the pixel circuits, where one of the pixel circuits comprises an organic light emitting diode (OLED) device, such as shown in FIG. 2. Further, the pixel circuit, as shown further, comprises a driving transistor G3, a first transistor G2, a second transistor G1, and a capacitor Cst. The driving transistor, the first transistor, and the second transistor are thin film transistors.

The number of sense lines Sense and the number of the data lines Data are equal, one of the sense lines coordinated with one of the data lines is connected to the pixel circuit, as shown in FIG. 1. Wherein each of the sense lines, connected to an anode of the OLED device via the first transistor, senses a voltage $V_{OLED}$ of the OLED device.

The first power supply ELVDD is connected to the driving transistor, the second power supply ELVSS is connected to the OLED device between the driving transistor and the second power supply. Specifically, a cathode of the OLED device is connected to the second power supply, the first power supply is connected to a drain of the driving transistor.

The source driving chip IC1 is connected to the data line and the sense line to transmit an image voltage and to generate, based on the voltage $V_{OLED}$ of the OLED device, a compensation voltage for compensating an aging of the OLED device.

Figure 3:
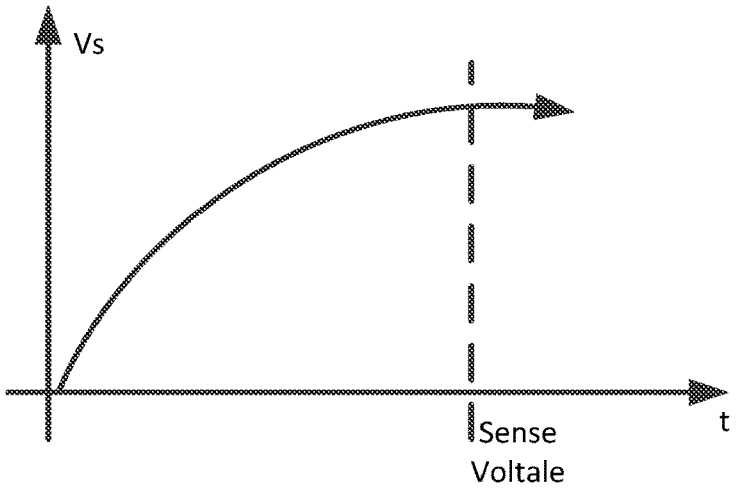
FIG. 3 is a schematic diagram of a waveform of the voltage $V_{OLED}$ under a sensing mode in an embodiment of the present disclosure.

The gate of the driving transistor G3 is connected to the data line via the second transistor, the drain of the driving transistor is connected to the first power supply, and the source of the driving transistor is connected to the anode of the OLED device. The sense lines are also used to sense a threshold voltage Vth and a mobility K of the driving transistor. The driving transistor is compensated by the source driving chip based on the threshold voltage Vth and the mobility K. As shown in FIGS. 2 and 3, a voltage Vs is an anode voltage of the OLED device, and is sensed at a point s by the sense line. FIG. 3 is a schematic diagram showing a variation of the anode voltage Vs of the OLED device with a sensing timing.

The sensing of the OLED devices is executed under the case of values of both the Vth and the K of the driving transistor being known.

In the embodiment of the present disclosure, the gate of the first transistor is connected to the gate driving chip, the source of the first transistor is connected to the anode of the OLED device, the drain of the first transistor is connected to the sense line; the gate of the second transistor is connected to the gate driving chip, the source of the second transistor is connected to the data line, the drain of the second transistor is connected to the gate of the driving transistor; the capacitor is connected between the gate of the driving transistor and the source of the driving transistor.

In the embodiment of the present disclosure, a first compensation voltage Vgs' is obtained by a formula:

$$Vgs' = \sqrt{\frac{K0}{K}}\ Vgs + Vth.$$

The first compensation voltage Vgs' is transmitted to the gate of the driving transistor via the data line for compensating the driving transistor, so that an amount of electric current required for sensing the aging of the OLED is acquired, such that the pixels having a same color on a screen have a same luminous current $I_0$; wherein the $K_0$ is an initial mobility.

Specifically, by the above steps, the pixels with the same color on the screen may be operated under the same luminous current normally. The voltage $V_{OLED}$ may be acquired by sensing the OLED device. The current luminous efficiency η is obtained by using the voltage $V_{OLED}$ of the OLED device as an index to map a lookup table, and a value of b is obtained by a formula: $b=\eta/\eta_0$, so that a second compensation voltage Vgs" is obtained by a formula:

$$Vgs'' = \sqrt{\frac{K0}{bK}}\ Vgs + Vth,$$

and is transmitted to the gate of the driving transistor via the data line to compensate the aging of the OLED device and the driving transistor; wherein $\eta_0$ is an initial luminous efficiency.

In the embodiment of the present disclosure, a plurality of testing chips (Test Element Group, TEG) driven by a passive manner are disposed at a periphery outside a display region of a display panel; the TEG is a plurality of OLED units without the transistors.

After the display panel is manufactured, the display panel may be divided into a plurality of TEGs. The TEGs may be illuminated by a passive manner for an execution of an aging testing through a high current. The high current is changed into a low current $I_{typ}$ on a constant duration during the aging testing. The voltage $V_{OLED}$ and a brightness L are measured and recorded under the low current $I_{typ}$, after the measurement of the voltage $V_{OLED}$ and the brightness L, the low current $I_{typ}$ is increases to the high current to continue the aging testing, the initial luminous efficiency $\eta_0$ is obtained by using an initial brightness $L_0$ and the low current $I_{typ}$ measured initially, which is followed by the low current $I_{typ}$ being used as one of measuring conditions to obtain the voltage $V_{OLED}$ and the brightness L, and to calculate the current luminous efficiency η for acquiring a relationship between the voltage $V_{OLED}$ and the current luminous efficiency q; the voltage $V_{OLED}$ is used as an index to find the relationship between the voltage $V_{OLED}$ and the current luminous efficiency η in a lookup table. A value of the low current $I_{typ}$ set by a current intensity of one of the TEGs, is equal to a luminous current intensity of the pixel passed through a current $I_0$, that is $I_{typ}=I_0*A_{TEG}/A_{pixel}$.

$A_{TEG}$ is a luminous area of a test piece driven by a passive manner, $A_{pixel}$ is a luminous area of the pixel circuit, and $V_{OLED}$ is the voltage of the test piece in the passive driving manner.

FIG. 4 is a timing diagram of the pixel circuit under the sensing mode in an embodiment of the present disclosure. During the sensing of the voltage of the OLED device of the embodiments of the present disclosure, the known values of the Vth and the K are used in this embodiment, to sense the voltage of the OLED device. The OLED device is in a stable illumination state when the OLED device is sensed, with the corresponding current $I_0$. The scan manner of the sensing in the screen is progressive, the different colors in the same column are sensed at the same time, and the sensing of each column is divided into three periods T1, T2, and T3. During the period T1, the transistors G1 and G2 are both turned on, a voltage of zero volts is written to the source of the driving transistor via the sense line Sense, the voltage Vgs' is written to the gate of the driving transistor via the data line Data, the $$Vgs' = \sqrt{\frac{K0}{K}}\ Vgs + Vth$$

at the same time. During the period T2, the transistor G1 is turned off, the transistor G2 remains on, the sense line Sense is set to float, the voltage Vs is raised due to the volume of the current ID being constant, so that the OLED device emits light. At this moment, the volume of the currents ID of the same color pixels on the entire screen are equal. During the period T3, the voltage Vs is sampled by the source driving chip IC1.

The current luminous efficiency η is obtained by using the voltage $V_{OLED}$ of the OLED device as an index to map a lookup table, and a value of b is obtained by a formula:

$$b = \eta/\eta_0,$$

so that a second compensation voltage Vgs" is obtained by a formula:

$$Vgs'' = \sqrt{\frac{K0}{bK}}\ Vgs + Vth,$$

Vgs+Vth, and is transmitted to the gate of the driving transistor via the data line to realize the voltage compensation, to improve problems of the decrease in brightness caused by the aging of the OLED device and a display with residual images, thereby enhancing the uniformity of an OLED display screen.

Figure 5:
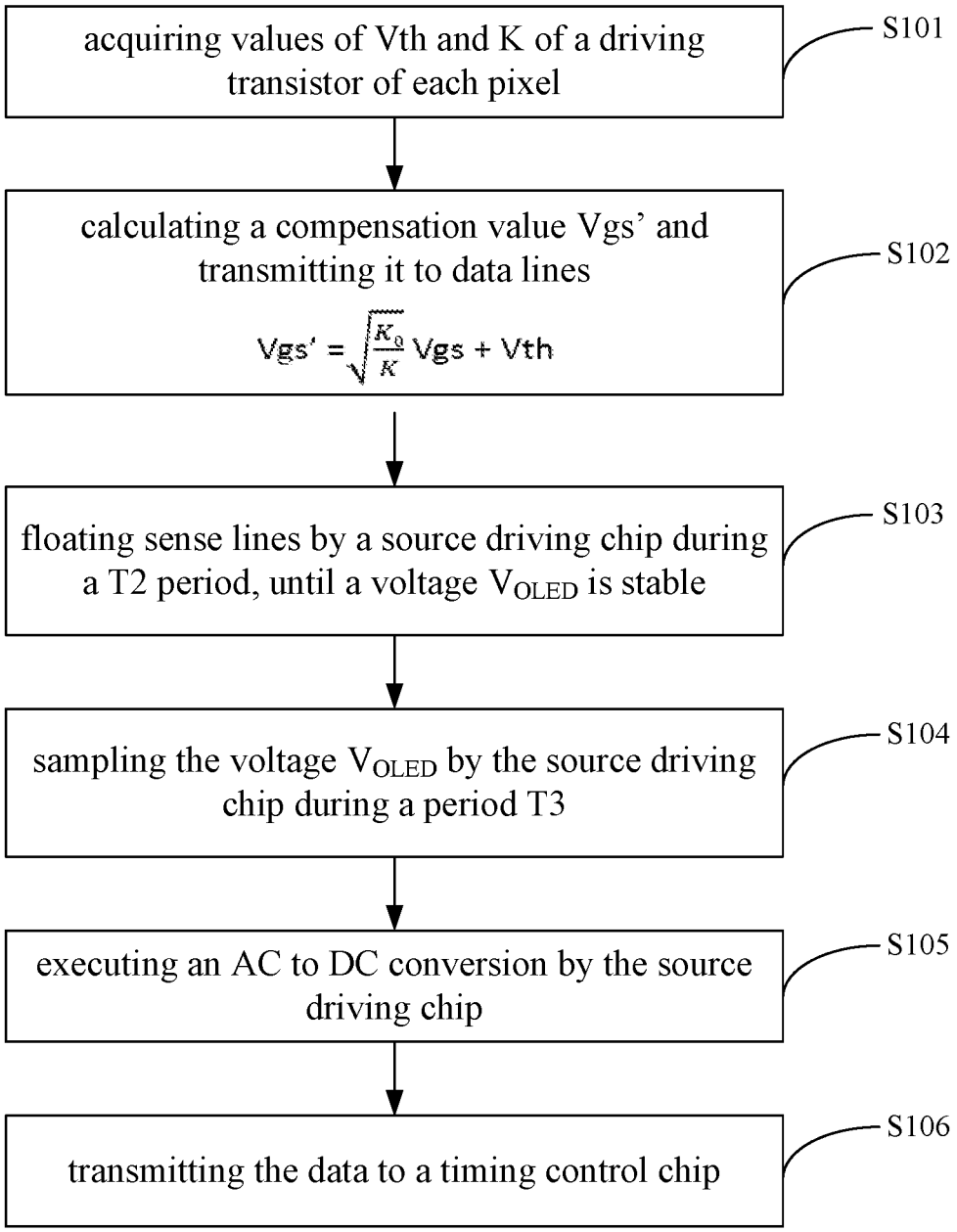
FIG. 5 is a flowchart of a sensing method for the OLED device in an embodiment of the present disclosure.
Figure 6:
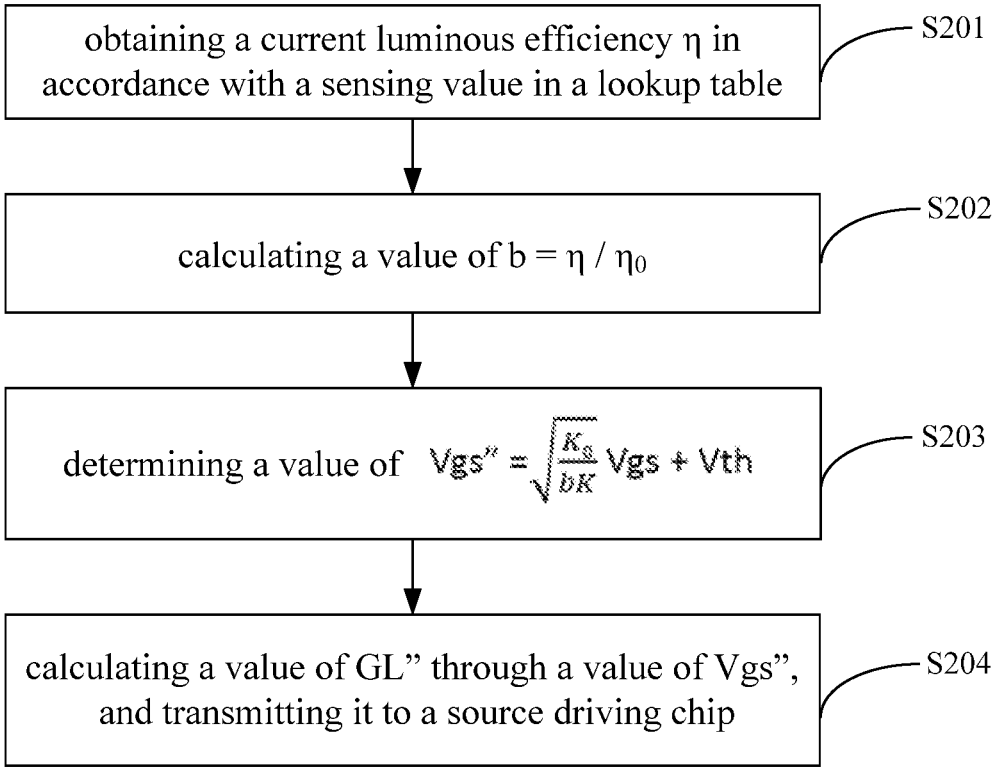
FIG. 6 is a flowchart of a compensating method for the driving transistor and the OLED device in an embodiment of the present disclosure.

As shown in FIGS. 5 and 6, an aging compensation method for the OLED device is also provided in the embodiment of the present disclosure, which is applied to an aging compensation system for the OLED device, in coordination with FIGS. 1 to 4. The aging compensation system comprises the pixel circuits, the data lines Data, the sense lines Sense, the first power supply ELVDD, the second power supply ELVSS, the source driving chip IC1 and the gate driving chip IC2.

The first power supply ELVDD is connected to the driving transistor, the second power supply is connected to the OLED device between the driving transistor and the second power supply. Specifically, the second power supply is connected to the cathode of the OLED device, and the first power supply is connected to the anode of the OLED device.

The aging compensation method for the OLED device comprises the following steps:

S101, acquiring values of the Vth and the K of the driving transistor of each pixel.

S102, calculating the value of the compensation of the voltage Vgs', and transmitting to the data lines.

S103, floating the sense lines by the source driving chip during the T2 period, until the voltage $V_{OLED}$ is stable.

S104, sampling the voltage $V_{OLED}$ by the source driving chip during the period T3 and acquiring the voltage $V_{OLED}$ of the OLED device.

S105, executing an AC to DC conversion by the source driving chip.

S106, transmitting the data to the timing control chip.

The aging compensation method for the OLED device further comprises the following steps:

S201, obtaining a current luminous efficiency η by using the voltage $V_{OLED}$ of the OLED device as an index to map a lookup table.

S202, calculating a value of $b=\eta/\eta_0$.

$$Vgs'' = \sqrt{\frac{K0}{bK}}\ Vgs + Vth.$$

S203, calculating a compensation voltage

S204, translating the compensation voltage Vgs" into an outputting gray-level GL", and transmitting to the source driving chip.

While the present disclosure has been disclosed with reference to preferred embodiments, the above-described embodiments are not intended to limit the present disclosure, and a person having ordinary skill in the art will be able to make various changes and modifications without departing from the spirit and scope of the present disclosure, and thus the scope of the present disclosure is defined by the scope of the claims.

What is claimed is:

1. An aging compensation system for an organic light emitting diode (OLED) device, comprising:

a plurality of pixel circuits, each pixel circuit comprising an OLED device and a driving transistor, the driving transistor being a thin film transistor;

a plurality of data lines;

a plurality of sense lines, wherein number of sense lines is equal to number of the data lines, each of the sense lines cooperating with each of the data lines in connection with the pixel circuits, wherein each of the sense lines, connected to an anode of the OLED device via a first transistor, senses a voltage $V_{OLED}$ of the OLED device;

a first power supply connected to the driving transistor;

a second power supply connected to a cathode of the OLED device between the driving transistor and the second power supply;

a gate driving chip, wherein the pixel circuit comprises a second transistor, wherein a gate of the driving transistor is connected to the data lines via the second transistor, a drain of the driving transistor is connected to the first power supply, and the source of the driving transistor is connected to the anode of the OLED device;

wherein the first compensation voltage Vgs' is obtained by a formula:

$$Vgs' = \sqrt{\frac{K0}{K}}\ Vgs + Vth,$$

the first compensation voltage Vgs' is transmitted to the gate of the driving transistor via the data lines for compensating the driving transistor, so an amount of electric current required for sensing the aging of the OLED is acquired, such that the pixels having a same color on a screen have a same luminous current; and wherein the $K_0$ is an initial mobility, the Vth is a threshold voltage of the driving transistor, the K is a mobility of the driving transistor, and Vgs is a voltage between a gate and a source of the driving transistor; and a source driving chip connected to both of the data lines and the sense lines, to transmit an image voltage and to generate, based on the voltage $V_{OLED}$ of the OLED device, a compensation voltage for compensation of aging of the OLED device.

2. The aging compensation system of the OLED device as claimed in claim 1, wherein a current luminous efficiency η is obtained by using the voltage $V_{OLED}$ of the OLED device as an index to map a lookup table, and a value of b is obtained by a formula: $b=\eta/\eta_0$, so that a second compensation voltage Vgs" is obtained by a formula as $$Vgs'' = \sqrt{\frac{K0}{bK}}\ Vgs + Vth,$$

and is transmitted to the gate of the driving transistor via the data line for compensating for the aging of the OLED device and compensating the driving transistor; wherein $\eta_0$ is an initial luminous efficiency.

3. The aging compensation system for the OLED device as claimed to claim 1, wherein the pixel circuit further comprises a capacitor; the gate of the first transistor is connected to the gate driving chip, the source of the first transistor is connected to an anode of the OLED device, and the drain of the first transistor is connected to the sense line; the gate of the second transistor is connected to the gate driving chip, the source of the second transistor is connected to the data line, and the drain of the second transistor is connected to the gate of the driving transistor; the capacitor is connected between the gate of the driving transistor and the source of the driving transistor.

4. The aging compensation system for the OLED device as claimed in claim 1, wherein the first transistor is a thin film transistor and the second transistor is a thin film transistor.

5. An aging compensation system for an OLED device, comprising:

a plurality of pixel circuits, each pixel circuit comprising an OLED device and a driving transistor;

a plurality of data lines;

a plurality of sense lines, wherein number of sense lines is equal to number of the data lines, each of the sense lines being coordinated with each of the data lines in connection with the pixel circuits, wherein each of the sense lines, connected to an anode of the OLED device via a first transistor, senses a voltage $V_{OLED}$ of the OLED device;

a first power supply connected to the driving transistor;

a second power supply connected to a cathode of the OLED device between driving transistor and the second power supply;

a gate driving chip, wherein the pixel circuit comprises a second transistor, a gate of the driving transistor is connected to the data lines via the second transistor, a drain of the driving transistor is connected to the first power supply, and the source of the driving transistor is connected to the anode of the OLED device;

wherein the first compensation voltage Vgs' is obtained by a formula:

$$Vgs' = \sqrt{\frac{K0}{K}}\ Vgs + Vth,$$

the first compensation voltage Vgs' is transmitted to the gate of the driving transistor via the data lines for compensating the driving transistor, so an amount of electric current required for sensing the aging of the OLED is acquired, such that the pixels having a same color on a screen have a same luminous current; and wherein the $K_0$ is an initial mobility, the Vth is a threshold voltage of the driving transistor, the K is a mobility of the driving transistor, and Vgs is a voltage between a gate and a source of the driving transistor; and a source driving chip connected to both of the data lines and the sense lines, to transmit an image voltage and to generate, based on the voltage $V_{OLED}$ of the OLED device, a compensation voltage for compensating for aging of the OLED device.

6. The aging compensation system for the OLED device as claimed in claim 5, wherein a current luminous efficiency $\eta$ is obtained by using the voltage $V_{OLED}$ of the OLED device as an index to map a lookup table, and a value of b is obtained by a formula: $b=\eta/\eta_0$, so that a second compensation voltage Vgs" is obtained by a formula:

$$Vgs'' = \sqrt{\frac{K0}{bK}}\ Vgs + Vth;$$

and is transmitted to the gate of the driving transistor via the data line to compensate the aging of the OLED device and the driving transistor; wherein $\eta_0$ is an initial luminous efficiency.

7. The aging compensation system for the OLED device as claimed in claim 5, wherein the pixel circuit further includes a capacitor; the gate of the first transistor is connected to the gate driving chip, the source of the first transistor is connected to an anode of the OLED device, and the drain of the first transistor is connected to the sense line; the gate of the second transistor is connected to the gate driving chip, the source of the second transistor is connected to the data line, and the drain of the second transistor is connected to the gate of the driving transistor; the capacitor is connected between the gate of the driving transistor and the source of the driving transistor.

8. The aging compensation system for the OLED device as claimed in claim 5, wherein the first transistor is a thin film transistor, and the second transistor is a thin film transistor.

9. An aging compensation method for an OLED device being applied to an aging compensation system for the OLED device, the aging compensation system comprising:

a plurality of pixel circuits, each pixel circuit comprising an OLED device and a driving transistor;

a plurality of data lines;

a plurality of sense lines, wherein number of sense lines is equal to number of the data lines, each of the sense lines cooperating with each of the data lines in connection with the pixel circuits, wherein each of the sense lines, connected to an anode of the OLED device via a first transistor, senses a voltage $V_{OLED}$ of the OLED device;

a first power supply connected to the driving transistor;

a second power supply connected to a cathode of the OLED device between driving transistor and the second power supply;

a source driving chip, connected to the data line and the sense line, to transmit an image voltage and to generate, based on the voltage $V_{OLED}$ of the OLED device, a compensation voltage for compensating for aging of the OLED device;

the aging compensation method comprising steps of:

compensating both values of a Vth and a K of the driving transistor first, such that the pixels having a same color on a screen are provided with a same luminous current;

acquiring a voltage $V_{OLED}$ when the OLED device is illuminated;

using the acquired voltage $V_{OLED}$ of the OLED device as an index to map a lookup table for obtaining a current luminous efficiency $\eta$, and a value of the b acquired based on a formula: $b=\eta/\eta_0$;

generating a compensating voltage based on a formula:

$$Vgs'' = \sqrt{\frac{K0}{bK}}\ Vgs + Vth;$$

transmitting the compensating voltage to a gate of the driving transistor via the data line;

wherein the $K_0$ is an initial mobility, the Vth is a threshold voltage of the driving transistor, the K is a mobility of the driving transistor, and Vgs is a voltage between a gate and a source of the driving transistor.

10. The aging compensation method for the OLED device as claimed in claim 9, wherein the aging compensation system further comprises a gate driving chip; the pixel circuit includes a second transistor; the gate of the driving transistor is connected to the data line via the second transistor, the gate of the driving transistor is connected to a first power supply, and the source of the driving transistor is connected to an anode of the OLED device.

11. The aging compensation method for the OLED device as claimed in claim 10, wherein the pixel circuit further comprises a capacitor; the gate of the first transistor is connected to a gate driving chip, the source of the first transistor is connected to an anode of the OLED device, and the drain of the first transistor is connected to the sense line; the gate of the second transistor is connected to the gate driving chip, the source of the second transistor is connected to the data line, and the drain of the second transistor is connected to the gate of the driving transistor; the capacitor is connected between the gate of the driving transistor and the source of the driving transistor.

12. The aging compensation method for the OLED device as claimed in claim 10, wherein after a display panel is manufactured, the display panel is sliced into a plurality of test element groups (TEGs), the TEGs are illuminated by a passive manner for an execution of an aging testing through a high current, the high current is changed into a low current $I_{typ}$ on a constant duration during an aging testing, the voltage $V_{OLED}$ and a brightness L are measured and recorded under the low current $I_{typ}$, after the measurement of the voltage $V_{OLED}$ and the brightness L, the low current $I_{typ}$ is increased to the high current to continue the aging testing, the initial luminous efficiency $\eta_0$ is obtained by using an initial brightness $L_0$ and the low current $I_{typ}$ measured initially, which is followed by the low current $I_{typ}$ being used as a measuring condition, to obtain the voltage $V_{OLED}$ and the brightness L, and to calculate the current luminous efficiency $\eta$ for acquiring a relationship between the voltage $V_{OLED}$ and the current luminous efficiency $\eta$; the voltage $V_{OLED}$ is used as an index to find a relationship between the voltage $V_{OLED}$ and the current luminous efficiency $\eta$ in a lookup table; a value of the low current $I_{typ}$ set by a current intensity of one of the TEGs, is equal to a luminous current intensity of the pixel passed through a current $I_0$, that is $I_{typ}=I_0*A_{TEG}/A_{pixel}$; wherein the $A_{TEG}$ is a luminous area of a test piece driven by a passive manner, the $A_{pixel}$ is a luminous area of the pixel circuit, and the $V_{OLED}$ is the voltage of the test piece driven by the passive manner.

13. The aging compensation method for the OLED device as claimed in claim 10, wherein the second transistor is a thin film transistor.

14. The aging compensation method for the OLED device as claimed in claim 9, wherein the current luminous efficiency $\eta$ is obtained by using the voltage $V_{OLED}$ of the OLED device as the index to map the lookup table, and the value of b is obtained by the formula: $b=\eta/\eta_0$, so that a second compensation voltage Vgs" is obtained by a formula:

$$Vgs'' = \sqrt{\frac{K0}{bK}}\ Vgs + Vth,$$

and is transmitted to the gate of the driving transistor via the data line to compensate for the aging of the OLED device and the driving transistor; wherein $\eta_0$ is an initial luminous efficiency.

15. The aging compensation method for the OLED device as claimed in claim 9, wherein the driving transistor is a thin film transistor.

16. The aging compensation method for the OLED device as claimed in claim 9, wherein the first transistor is a thin film transistor.

* * * * *